US007897024B2

(12) United States Patent
Yahagi et al.

(10) Patent No.: US 7,897,024 B2
(45) Date of Patent: Mar. 1, 2011

(54) CONDUCTING BELT FOR USE WITH ANODE HOLDER AND ANODE HOLDER

(75) Inventors: Mitsutoshi Yahagi, Tokyo (JP); Kenichi Abe, Tokyo (JP); Yuji Araki, Tokyo (JP); Yoshio Minami, Tokyo (JP); Tomoyasu Nagayumi, Tokyo (JP)

(73) Assignee: Ebara Corporation, Tokyo (JP)

( * ) Notice: Subject to any disclaimer, the term of this patent is extended or adjusted under 35 U.S.C. 154(b) by 483 days.

(21) Appl. No.: 12/073,348

(22) Filed: Mar. 4, 2008

(65) Prior Publication Data

US 2009/0050473 A1 Feb. 26, 2009

(30) Foreign Application Priority Data

Aug. 20, 2007 (JP) ..... 2007-213521

(51) Int. Cl.
*C25B 9/04* (2006.01)
*C25D 17/06* (2006.01)
*C25D 17/08* (2006.01)

(52) U.S. Cl. ..... 204/279; 204/286.1; 204/297.01; 204/278.5; 204/198; 204/224 R; 204/232; 204/237; 204/280

(58) Field of Classification Search ..... 204/198, 204/224 R, 232, 237, 278.5, 280, 286.1, 297.01, 204/279

See application file for complete search history.

(56) References Cited

U.S. PATENT DOCUMENTS

| | | | | |
|---|---|---|---|---|
| 6,800,812 | B1 * | 10/2004 | Franks, Jr. | 174/136 |
| 6,830,667 | B2 | 12/2004 | Yamamoto | |
| 7,507,319 | B2 * | 3/2009 | Kuriyama et al. | 204/288.4 |
| 2006/0113185 | A1 * | 6/2006 | Kuriyama et al. | 204/275.1 |
| 2007/0238265 | A1 * | 10/2007 | Kurashina et al. | 438/470 |

FOREIGN PATENT DOCUMENTS

JP 2005-029863 2/2005

* cited by examiner

*Primary Examiner*—Bruce F Bell
(74) *Attorney, Agent, or Firm*—Wenderoth, Lind & Ponack, L.L.P.

(57) ABSTRACT

A conducting belt is used with an anode holder for supplying an electric current to an anode for plating a surface of a substrate such as a semiconductor wafer. The anode and the substrate are vertically disposed so as to face each other in a plating tank of a plating apparatus. The conducting belt includes a belt capable of contacting an outer circumferential edge of the anode and holding the anode.

25 Claims, 14 Drawing Sheets

CONDUCTING BELT FOR USE WITH ANODE HOLDER AND ANODE HOLDER

BACKGROUND OF THE INVENTION

1. Field of the Invention

The present invention relates to a conducting belt for use with an anode holder and an anode holder, and more particularly to a conducting belt for supplying an electric current to an anode for plating a surface of a substrate such as a semiconductor wafer, and an anode holder for holding such an anode. The present invention is also concerned with a plating apparatus for plating a substrate using the conducting belt. The plating apparatus may be a bump plating apparatus for forming bumps on a surface of a semiconductor substrate or a plating apparatus for plating via holes having high aspect ratios and large depths, e.g., a diameter of 10 μm to 20 μm and a depth of 70 μm to 150 μm.

2. Description of the Related Art

In recent years, there has been used a method of forming metal films and organic films on substrates such as semiconductor wafers by a plating process in forming semiconductor circuit interconnections and bumps. For example, it has widely been practiced to form bumps (protruding connecting electrode) or interconnections of gold, silver, copper, solder, nickel or a multilayer of these metals at predetermined portions on a surface of a semiconductor wafer having semiconductor circuits and fine interconnections for connecting semiconductor circuits, thereby electrically connecting the semiconductor circuits via the bumps to electrodes of a package substrate or tape automated bonding (TAB) electrodes. The interconnections and the bumps may be formed by any of various methods including an electroplating method, an electroless plating method, a vapor deposition method, and a printing method. Of these methods, the electroplating process has been used most widely because it can produce finer patterns at a higher film deposition rate to produce semiconductor chips with more I/O terminals and smaller pitches. For details, reference should be made to Japanese laid-open patent publication No. 2000-96292. Metal films formed by the electroplating process that are most widely used have characteristics of high purity, high deposition rate, and easy film-thickness control.

FIG. 15 of the accompanying drawings schematically shows a vertical-immersion plating apparatus in which a substrate and an anode are vertically placed in a plating tank. As shown in FIG. 15, the plating apparatus includes a plating tank 101 containing a plating solution Q therein. An anode 103 held by an anode holder 102 and a substrate W held by a substrate holder 104 are vertically immersed in the plating solution Q in such a manner that the anode 103 and the substrate W are spaced in confronting relation from each other and lie parallel to each other. When an electric current is supplied between the anode 103 and the substrate W by a plating power supply 105, a surface W1 of the substrate W which is exposed from the substrate holder 104 is electroplated. The plating tank 101 is combined with a plating solution circulator 106 for circulating the plating solution Q by supplying the plating solution Q from an inlet port 111 into the plating tank 101 and discharging the plating solution Q from the plating tank 101 through an outlet port 112.

As shown in FIG. 15, the vertical-immersion plating apparatus performs plating of the substrate W by placing the substrate W so as to face the anode 103 that is held by the anode holder 102. Although a plate-like anode is shown as an anode, an anode ball housed in a cage may be used as an anode. However, the plate-like anode held by the anode holder offers the following advantages:

1) A shield plate may be mounted on the anode holder, and such shield plate may make it possible to adjust the opening diameter of the anode, thereby easily controlling in-plane uniformity (see, for example, Japanese laid-open patent publication No. 2005-29863).

2) Because the anode is in the form of a plate, the anode can easily be held parallel to the substrate to improve in-plane uniformity.

As described above, using the anode holder to hold the anode while the substrate is being plated by the vertical-immersion plating apparatus is advantageous. However, the plating apparatus is required to have the following functions in order to meet growing demands for finer interconnections and increased throughputs:

1) Finer interconnections to be formed on substrates require certainty of supply of an electric current to the anode.

2) As the substrate to be processed is larger in size, the anode is also larger in size. Since the larger anode cannot easily be replaced manually with another anode due to their weight, a new jig is needed for anode replacement.

3) The replacement of the anode needs to be performed efficiently in a short period of time.

SUMMARY OF THE INVENTION

It is an object of the present invention to provide a conducting belt and an anode holder which can reliably supply an electric current to an anode, can allow easy replacement of the anode with a new anode, and can improve the efficiency in replacement work of an anode to shorten operation time.

According to a first aspect of the present invention, there is provided a conducting belt for use with an anode holder for supplying an electric current to an anode, the anode and a substrate being vertically disposed so as to face each other in a plating tank of a plating apparatus, the conducting belt comprising: a belt capable of contacting an outer circumferential edge of the anode and holding the anode.

According to the present invention, the conductive belt can hold a disk-shaped anode by tightening the outer circumferential edge of the anode by a circular belt. Since the belt tightens the outer circumferential edge of the anode, an electric current is reliably supplied through the conducting belt to the anode. Thus, there is no need to perform positional alignment between the anode and the conducting belt, and the time required to replace the anode can be shortened. As the conducting belt usually has a width of 1 cm to 2 cm, the area of contact between the conducting belt and the anode is large, and any contact resistance between the conducting belt and the anode can be reduced.

In the preferred aspect of the present invention, the belt is capable of contacting the outer circumferential edge of the anode substantially in its entirety.

In a preferred aspect of the present invention, the belt has opposite ends fastened to each other by a fastener to hold the anode.

In a preferred aspect of the present invention, the fastener comprises a bolt and a nut.

In a preferred aspect of the present invention, there is provided a conducting belt further comprising an electrically conductive bracket fixed to an end of the belt, the electrically conductive bracket having a contact for supplying the electric current.

According to a second aspect of the present invention, there is provided an anode holder for vertically holding an anode, the anode and a substrate being vertically disposed so as to face each other in a plating tank of a plating apparatus, the anode holder comprising: an anode holder base having a hole defined therein for housing a conducting belt for supplying an electric current to the anode; and an anode mask mounted on the anode holder base for covering a portion of a front surface of the anode. The conducting belt comprises a belt capable of contacting an outer circumferential edge of the anode and holding the anode.

According to the present invention, the exposed area of the anode can be adjusted by the anode mask. Further, the conducting belt is masked by the anode holder and is not exposed to a plating solution during a plating process.

In a preferred aspect of the invention, an anode holder further comprises: a rear cover mounted on a rear surface of the anode holder base for covering a rear surface of the anode.

In a preferred aspect of the present invention, the anode mask has a circular opening, and the circular opening has a diameter smaller than the diameter of the anode.

In a preferred aspect of the present invention, the anode holder base includes a hand for transferring the anode holder.

In a preferred aspect of the present invention, the anode holder base includes a solution discharge hole for allowing a solution to be discharged therethrough.

According to a third aspect of the present invention, there is provided a plating apparatus comprising: a plating tank for vertically placing therein an anode holder holding an anode and a substrate holder holding a substrate thereon in confronting relation to each other; a temporary storing unit for exchanging the anode holder; and a transfer robot for transferring the anode holder between the plating tank and the temporary storing unit. The anode holder comprises an anode holder base having a hole defined therein for housing a conducting belt for supplying an electric current to the anode; and an anode mask mounted on the anode holder base for covering a portion of a front surface of the anode. The conducting belt comprises a belt capable of contacting an outer circumferential edge of the anode and holding the anode.

According to the present invention, the anode holder, which has such a structure as to cope with the transfer robot, can be conveyed by the transfer robot.

In a preferred aspect of the present invention, a plating apparatus further comprises: a cleaning tank for cleaning the anode holder.

In a preferred aspect of the present invention, a plating apparatus further comprises: a blowing tank for removing water droplets from the anode holder.

According to the present invention, the anode holder can be transferred by the transfer robot through a removal section to the outside of the apparatus after the anode holder is cleaned by cleaning water, and water droplets are removed from the anode holder.

According to a fourth aspect of the present invention, there is provided an anode held by a conducting belt for use with an anode holder for supplying an electric current to an anode. The anode and a substrate are vertically disposed so as to face each other in a plating tank of a plating apparatus. The conducting belt comprises a belt capable of contacting an outer circumferential edge of the anode and holding the anode.

In a preferred aspect of the present invention, the anode is disk-shaped.

The conducting belt according to the present invention offers the following advantages:

1) Since the conducting belt is brought into contact with the entire or substantially entire outer circumferential edge of the anode, the conducting belt can supply an electric current to the anode from the entire or substantially entire outer circumferential edge of the anode. Therefore, a contact failure is prevented from occurring between the conducting belt and the anode.

2) As the area of contact between the conducting belt and the anode is large, any contact resistance between the conducting belt and the anode is reduced.

3) Since the entire or substantially entire outer circumferential edge of the anode is secured by the conducting belt, there is no need to perform positional alignment between the anode and the conducting belt. Further, the anode can easily be machined because the anode is in the form of a circular disk.

4) The anode can easily be replaced with a new one simply by loosening the conducting belt, placing the new anode in position, and retightening the conducting belt.

5) Since the anode is in the form of a circular disk and is held by the conducting belt, the anode is free of wasteful areas.

The anode holder according to the present invention offers the following advantages:

1) The anode can easily be replaced with a new one simply by removing the rear cover, loosening the fastener, placing the new anode in position, retightening the fastener, and attaching the rear cover again.

2) The anode mask has its inside diameter smaller than the diameter of the anode. Therefore, even if the anode held by the conducting belt is overused beyond its replacement period, the anode is prevented from falling out of the anode holder or suffering from a conductive fault.

3) The solution discharge hole defined in the lower end of the anode holder allows the plating solution to be discharged quickly and reliably from the anode holder through the solution discharge hole.

The plating apparatus according to the present invention offers the following advantages:

1) Since the anode holder is removed by the transfer robot which is fully automatized, the anode holder can easily be replaced.

2) For removing the anode holder from the plating apparatus, the anode holder is taken out of the plating tank by the transfer robot, and cleaned in the cleaning tank to remove the plating solution from the anode holder. Then, water droplets are removed from the anode holder in the blowing tank, and the anode holder is removed from the plating apparatus through the temporary storing unit. Thus, the operator is not required to touch the plating solution for the removal of the anode holder, and hence the safety of the operator can be ensured.

3) Since the anode holder can easily be removed, the anode mask can easily be replaced.

4) The transfer robot has a high level of positioning accuracy, and can perform fine adjustment of position. Consequently, the anode holder can be placed in a desired position with high reproducibility, and the interelectrode distance between the substrate and the anode can easily be changed.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 15:
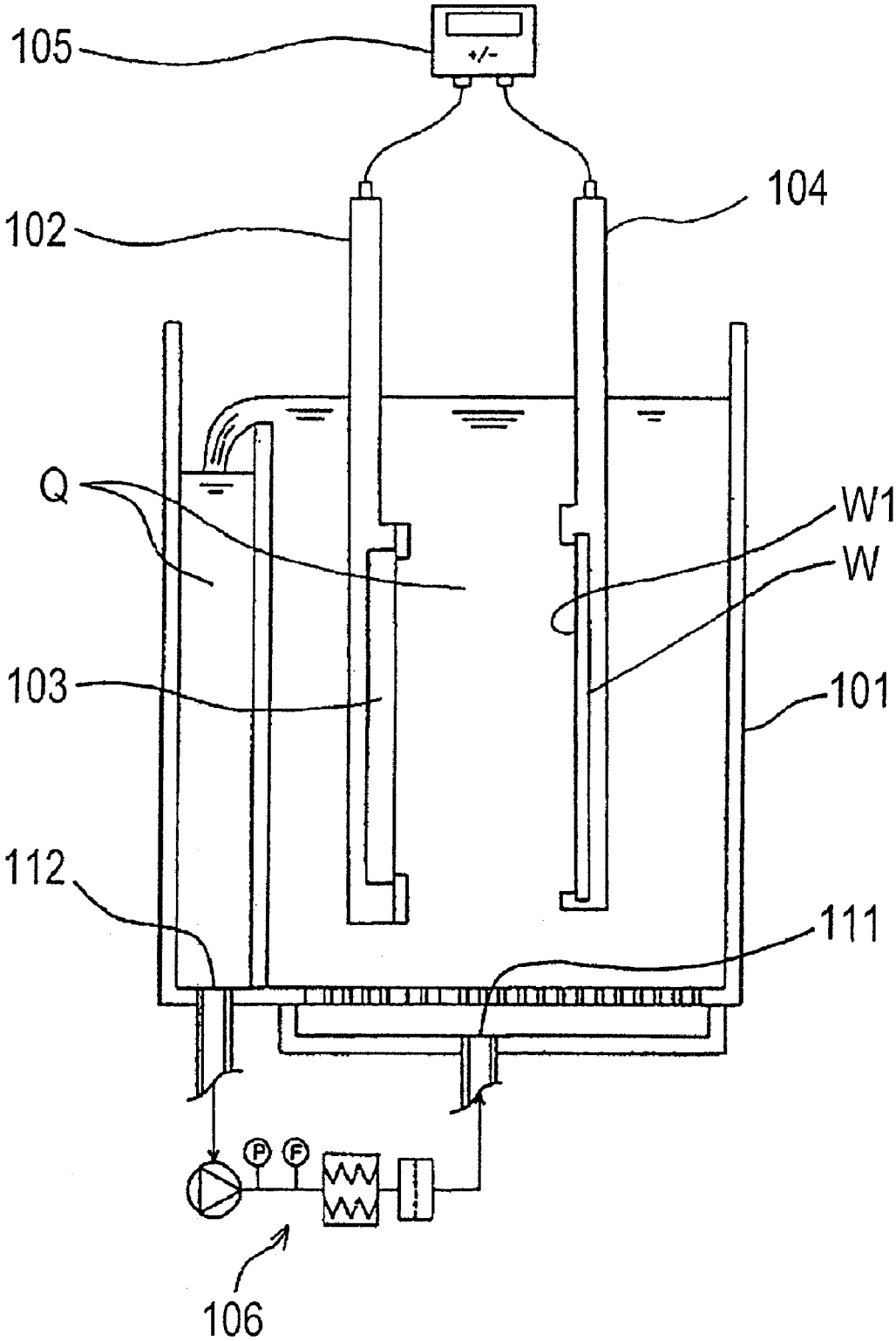
FIG. 15 PRIOR ART
FIG. 15 is a vertical cross-sectional view showing a conventional vertical-immersion plating apparatus in which a substrate and an anode are vertically placed in a plating tank.

A conducting belt for use with an anode holder and an anode holder according to an embodiment of the present invention will be described with reference to FIGS. 1 through 8. The conducting belt and the anode holder are typically employed in the vertical-immersion plating apparatus as shown in FIG. 15. Structural details of the plating apparatus having a plating tank will not be described below in the following embodiments.

Figure 1:
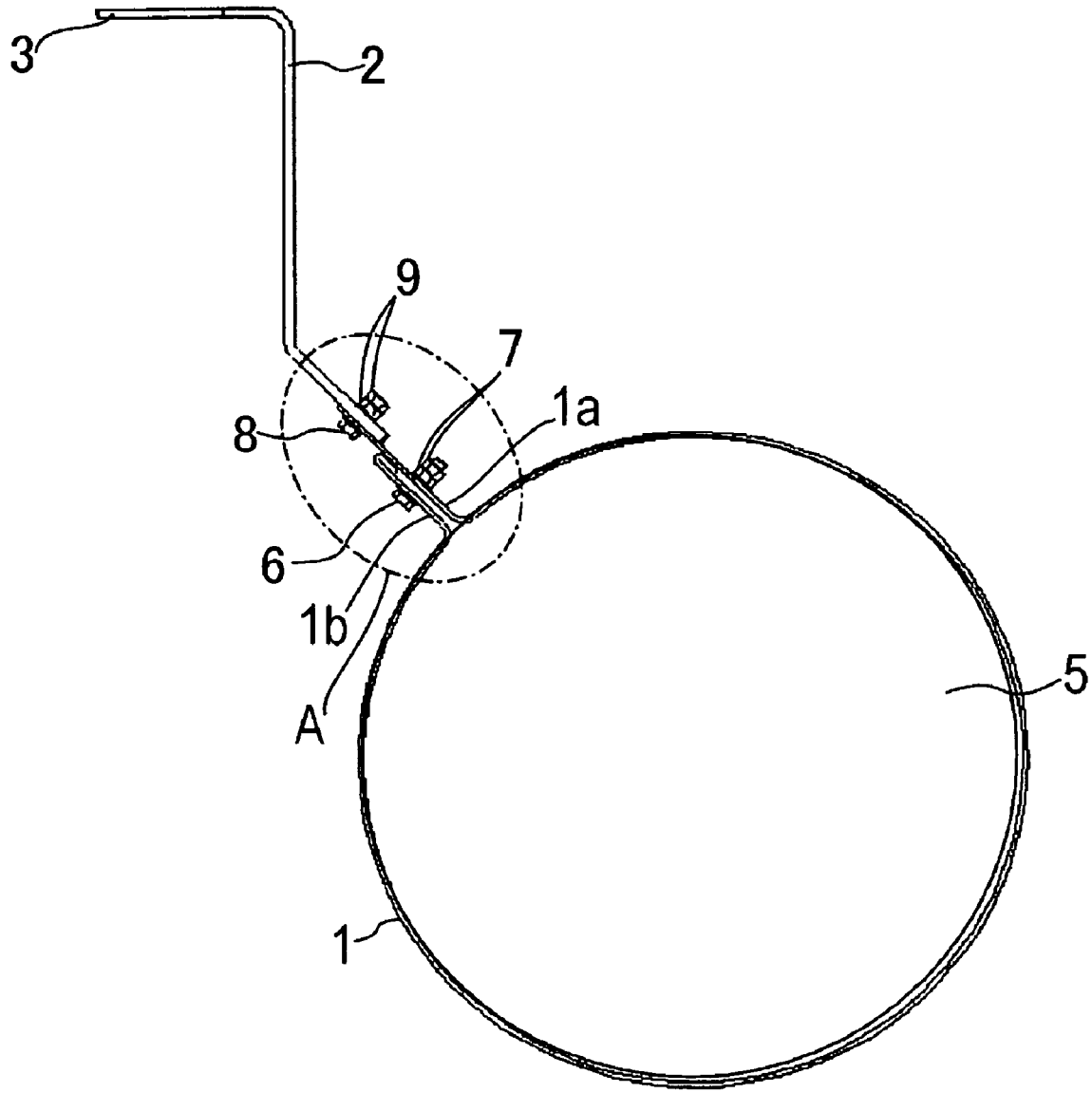
FIG. 1 is a front elevational view showing a conducting belt which holds an anode, the conducting belt being for use with an anode holder.
Figure 2:
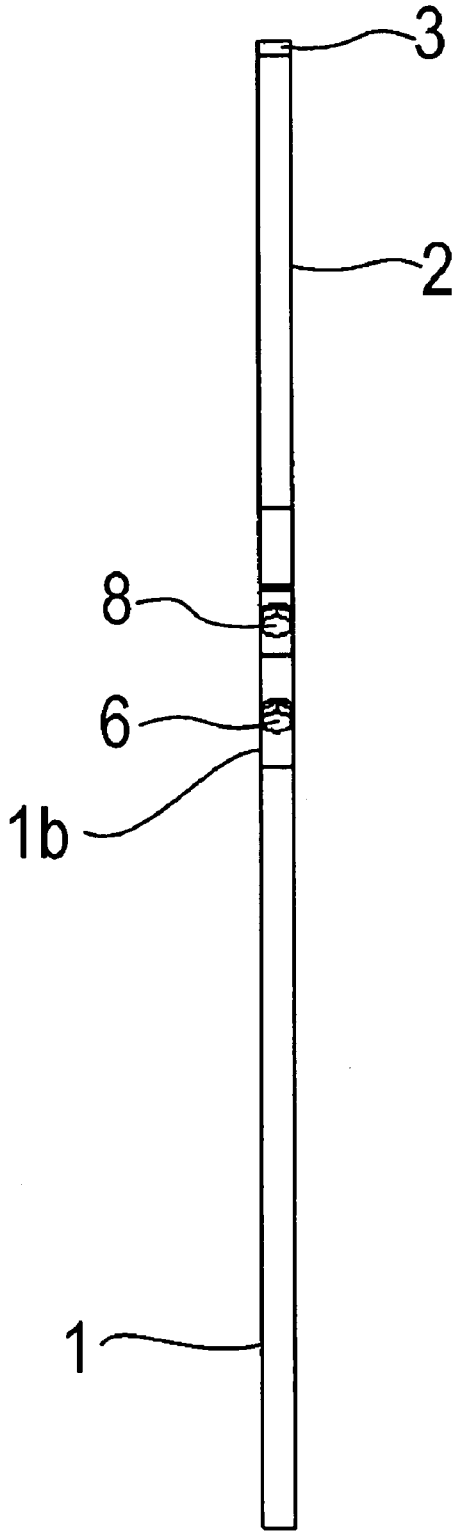
FIG. 2 is a side elevational view showing the conducting belt.

FIGS. 1 through 4 show a conducting belt for use with an anode holder according to the embodiment of the present invention. FIG. 1 is a front elevational view of a conducting belt which holds an anode, and FIG. 2 is a side elevational view of the conducting belt.

As shown in FIGS. 1 and 2, the conducting belt, generally denoted by 1, comprises a belt-like thin plate in the form of a ring composed of an electrically conductive material such as titanium. The conducting belt holds a disk-shaped anode 5 fitted therein. The conducting belt 1 has opposite ends 1*a*, 1*b* (holding portions) fastened to each other by a bolt 6 and nuts 7 (i.e., first fastener) to secure the anode 5 therein. The conducting belt 1 has a thickness of 1 mm to 3 mm and a width of 1 cm to 2 cm. Since a substrate W to be plated is in the form of a circular disk, the anode 5 is also in the form of a circular disk. The anode 5 has an outside diameter of 150 mm to 300 mm and a thickness of 10 mm to 20 mm.

Figure 3:
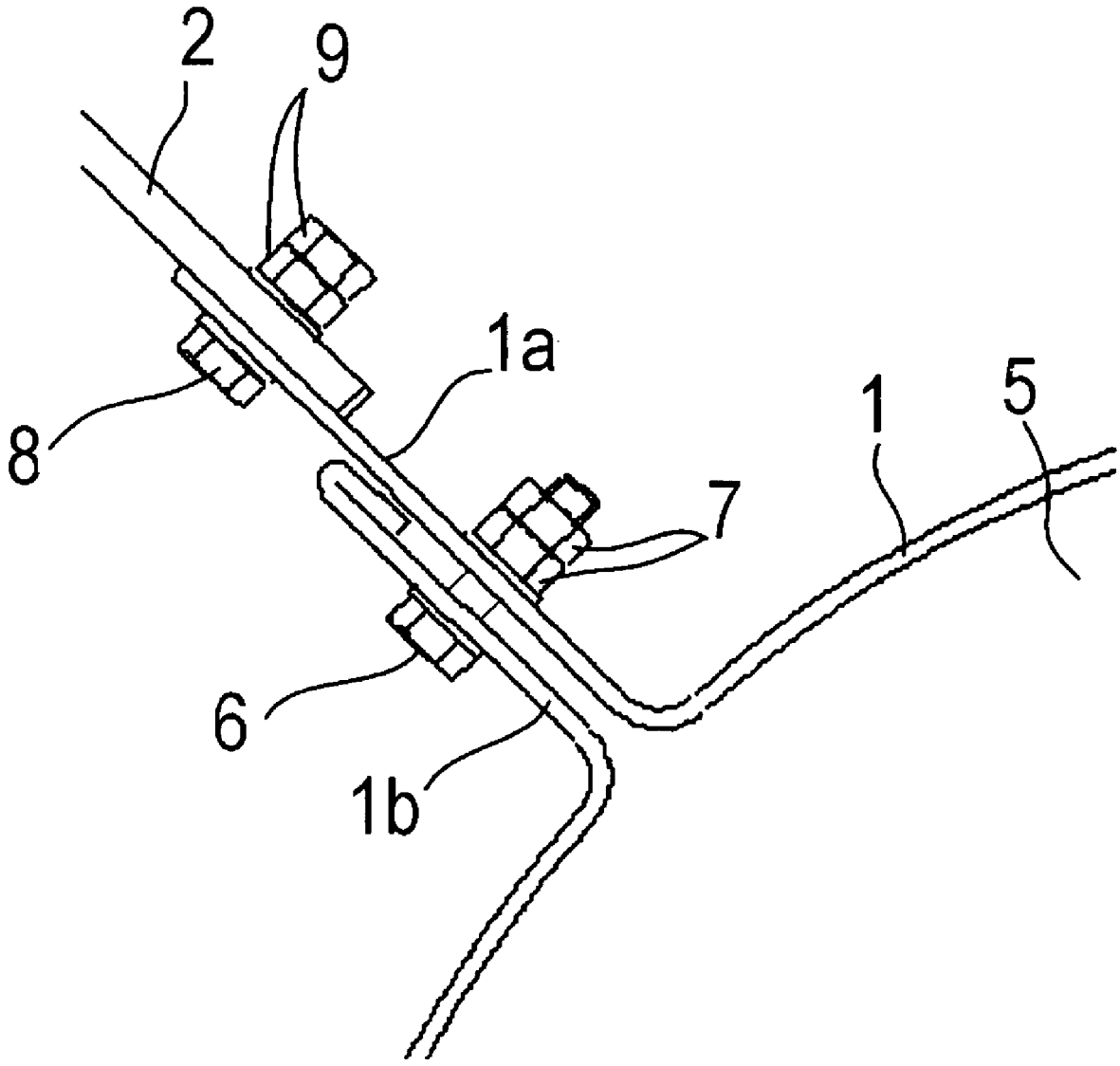
FIG. 3 is an enlarged view showing an encircled area A in FIG. 1, and showing a fastening assembly in detail.

FIG. 3 is an enlarged view showing an encircled area A in FIG. 1, and showing a fastening assembly in detail. As shown in FIG. 3, the bolt 6 is inserted into the opposite ends 1*a*, 1*b* of the conducting belt 1 and the double nuts 7 are screwed onto the bolt 6 to fasten the anode 5 by the conducting belt 1. The circular anode 5 has its outer circumferential edge which is entirely or substantially entirely in close contact with the inner circumferential surface of the conducting belt 1.

As shown in FIGS. 1 and 3, an electrically conductive bracket 2 is fixed to an extended fixing portion of the end 1*a* of the conducting belt 1 by a bolt 8 and double nuts 9 (i.e., second fastener). The electrically conductive bracket 2 has a contact 3 on its distal end. The contact 3 is brought into contact with a contact (not shown) provided in the plating tank, so that the contact 3 can be supplied with an electric current from a plating power supply.

Figure 4:
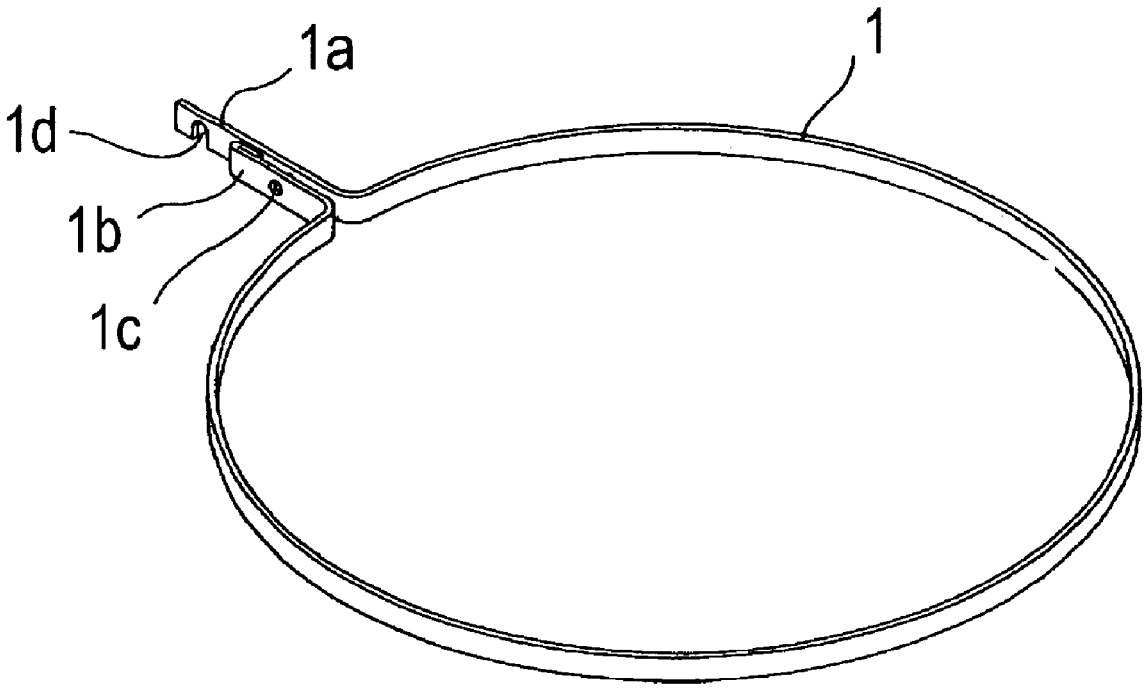
FIG. 4 is a perspective view showing the conducting belt.

FIG. 4 is a perspective view of the conducting belt 1.

As shown in FIG. 4, the ends 1*a*, 1*b* of the conducting belt 1 are bent radially outwardly from the circular thin plate at an angle of substantially 90°. The ends 1*a*, 1*b* have bolt insertion holes 1*c* defined therein for the insertion of the bolt 6 therethrough. The end 1*a* is longer than the end 1*b* and has a notch 1*d* defined therein for the insertion of the bolt 8 therethrough.

The conducting belt 1 which is constructed as shown in FIGS. 1 through 4 offers the following advantages:

1) Since the conducting belt 1 is brought into contact with the entire or substantially entire outer circumferential edge of the anode 5, the conducting belt 1 can supply an electric current to the anode 5 from the entire or substantially entire outer circumferential edge of the anode 5. Therefore, a contact failure is prevented from occurring between the conducting belt 1 and the anode 5.

2) As the area of contact between the conducting belt 1 and the anode 5 is large, any contact resistance between the conducting belt 1 and the anode 5 is reduced.

3) Since the entire outer circumferential edge of the anode 5 is secured by the conducting belt 1, there is no need to perform positional alignment between the anode 5 and the conducting belt 1. Further, the anode 5 can easily be machined because the anode 5 is in the form of a circular disk.

4) The anode 5 can easily be replaced with a new one simply by loosening the conducting belt 1, placing the new anode in position, and retightening the conducting belt 1.

5) Since the anode 5 is in the form of a circular disk and is held by the conducting belt 1, the anode 5 is free of wasteful areas.

Figure 5:
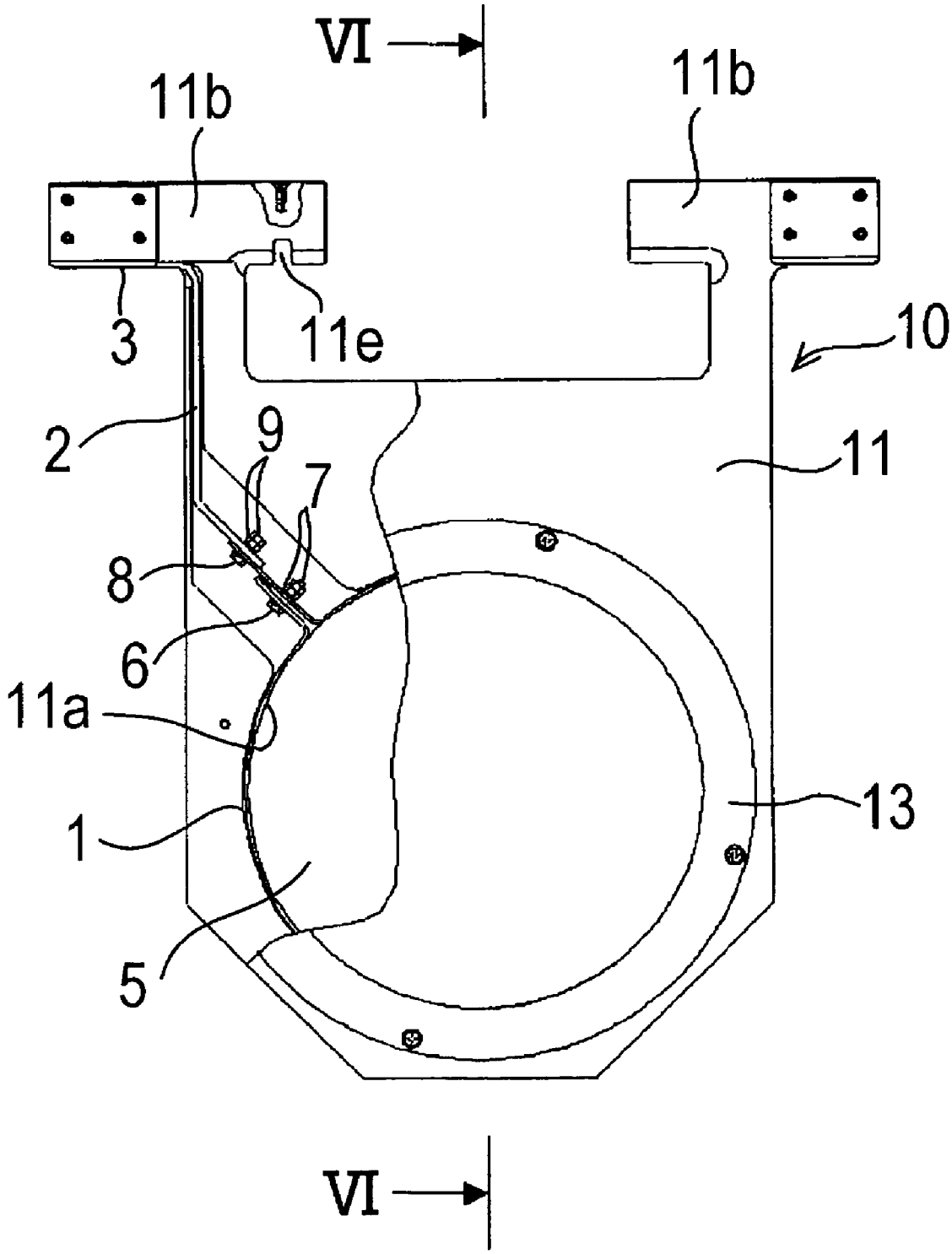
FIG. 5 is a front elevational view, partly in cross section, showing an anode holder.
Figure 6:
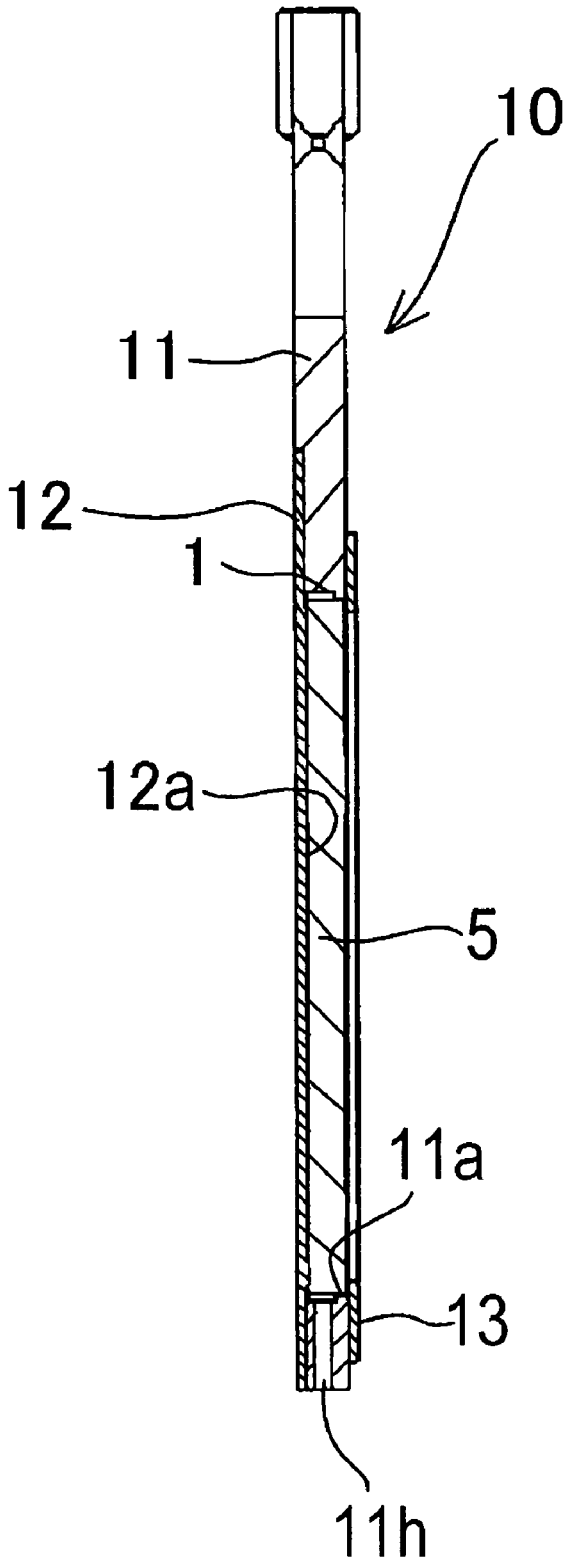
FIG. 6 is a cross-sectional view taken along line VI-VI of FIG. 5.
Figure 7:
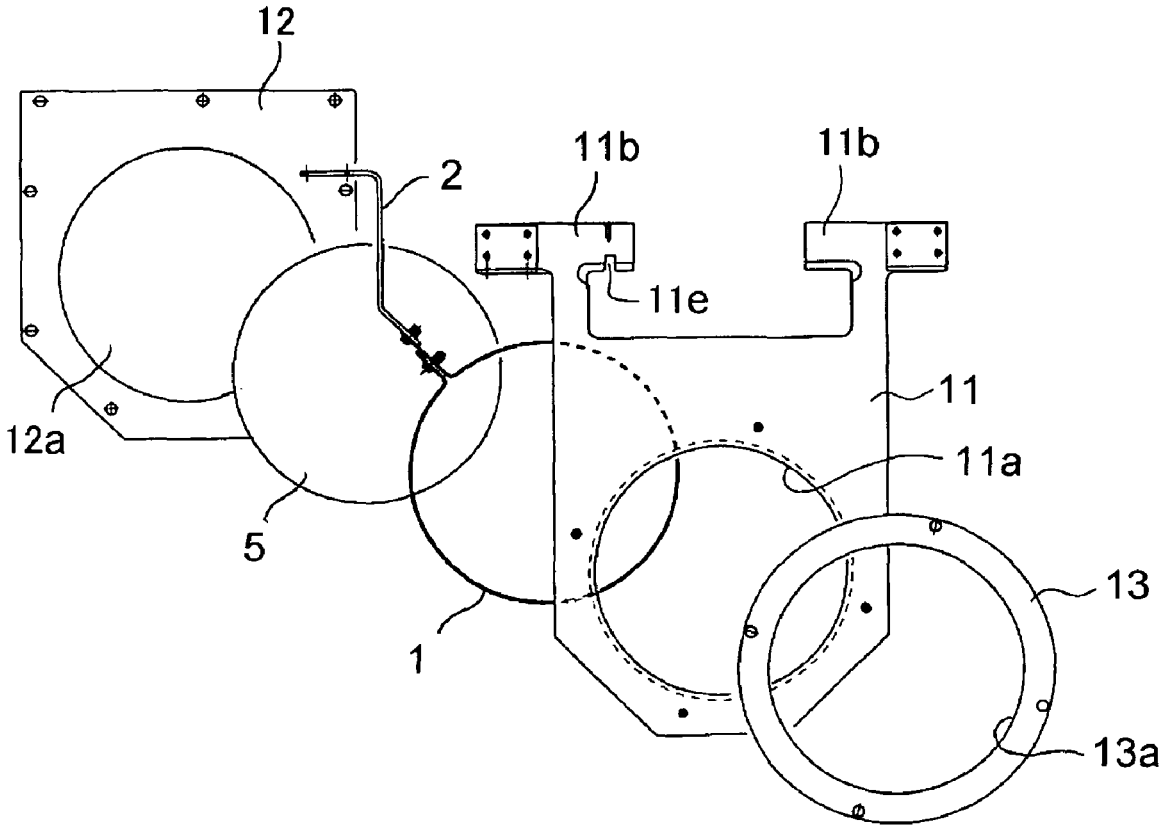
FIG. 7 is an exploded perspective view showing the anode holder.

The anode 5 and the conducting belt 1 shown in FIGS. 1 through 4 are held by an anode holder 10 shown in FIGS. 5 through 7. The anode holder 10 will be described below with reference to FIGS. 5 through 7.

FIG. 5 is a front elevational view, partly in cross section, of the anode holder 10, FIG. 6 is a cross-sectional view taken along line VI-VI of FIG. 5, and FIG. 7 is an exploded perspective view of the anode holder 10. As shown in FIGS. 5 and 6, the anode holder 10 comprises an anode holder base 11 for mounting thereon the anode 5 held by the conducting belt 1, a rear cover 12 mounted on the reverse surface of the anode holder base 11 for holding the reverse surface of the anode 5, and an anode mask 13 mounted on the front surface of the anode holder base 11 for covering a portion of the front surface of the anode 5.

As shown in FIG. 7, the anode holder base 11 is in the form of a substantially rectangular thin plate, and has a circular housing hole 11*a* defined centrally therein for housing the anode 5 that is held by the conducting belt 1. The anode holder base 11 has a pair of substantially T-shaped hands 11*b*, 11*b* on its upper end which can be gripped by a robot when the robot transfers the anode holder 10 for replacing the exhausted anode. As shown in FIG. 5, the contact 3 on the distal end of the electrically conductive bracket 2 connected to the conducting belt 1 is held on a lower surface of one of the hands 11*b*. As shown in FIG. 6, the anode holder base 11 has a solution discharge hole 11*h* defined in a lower end thereof for allowing the plating solution to be discharged quickly and reliably therethrough from the anode holder 10 when the anode holder 10 is lifted out of the plating tank for anode replacement.

As shown in FIG. 7, the rear cover 12 is in the form of a substantially rectangular thin plate, and has a circular pressing portion 12*a* disposed centrally thereon. As shown in FIG. 6, the circular pressing portion 12*a* is slightly thicker than the outer circumferential region of the rear cover 12. Thus, the circular pressing portion 12*a* is fitted into the circular housing hole 11*a* of the anode holder base 11 when the rear cover 12 is mounted on the anode holder base 11. Consequently, the circular pressing portion 12*a* presses the rear surface of the anode 5 that is housed in the circular housing hole 11*a*.

The anode mask 13 is in the form of an annular plate having a central opening 13*a* defined therein. The opening 13*a* of the anode mask 13 has a diameter smaller than the diameter of the anode 5, so that the anode mask 13 mounted on the anode holder base 11 covers or masks an outer peripheral portion of the anode 5 that is housed in the housing hole 11*a*. The diameter of the opening 13*a* can be selected to control the electric field on the front surface of the anode 5. The anode mask 13 is made of vinyl chloride, PEEK (polyether ether ketone), PVDF (polyvinylidene difluoride), or the like.

In FIGS. 5 through 7, the anode 5 mounted on the anode holder base 11 has its rear surface pressed by the rear cover 12. However, the anode 5 may have its front surface pressed by a front cover. In such a modification, the anode mask may be mounted on the front cover, or the front cover may double as the anode mask.

The anode holder 10 shown in FIGS. 5 through 7 offers the following advantages:

1) The anode 5 can easily be replaced with a new one simply by removing the rear cover 12, loosening the double nuts 7, placing the new anode 5 in position, retightening the double nuts 7, and attaching the rear cover 12 again.

2) The anode mask 13 has its inside diameter smaller than the diameter of the anode 5. Therefore, even if the anode 5 held by the conducting belt 1 is overused beyond its replacement period, the anode 5 is prevented from falling out of the anode holder 10 or suffering from a conductive fault.

3) The solution discharge hole 11*h* defined in the lower end of the anode holder 10 allows the plating solution to be discharged quickly and reliably from the anode holder 10 when the anode holder 10 is lifted out of the plating tank.

Figure 8:
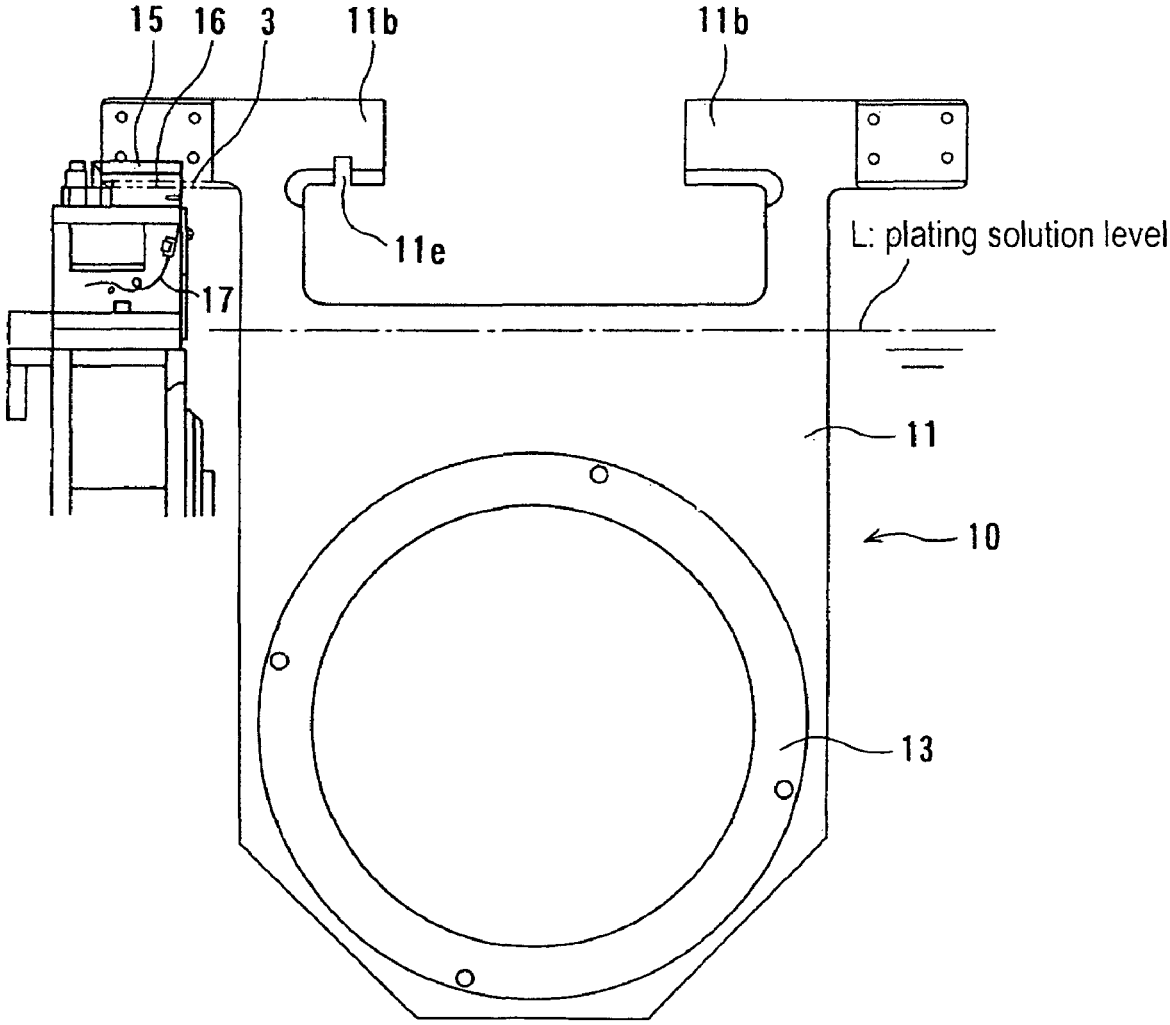
FIG. 8 is a view showing the anode holder which is immersed in a plating solution.

FIG. 8 shows the anode holder 10 which is immersed in the plating solution. As shown in FIG. 8, the anode holder 10 is disposed in the plating solution in such a manner that the hands 11*b*, 11*b* are positioned above a plating solution level L. The contact 3 held on one of the hands 11*b*, 11*b* is brought into contact with a contact plate 16 fixed to a holder 15 provided in the plating tank. The contact plate 16 is connected to the plating power supply (not shown in FIG. 8) through an electric supply line 17. Therefore, the anode 5 held by the anode holder 10 that is connected to the contact 3 is supplied with an electric current from the plating power supply through the electric supply line 17 and the contact plate 16.

Figure 9:
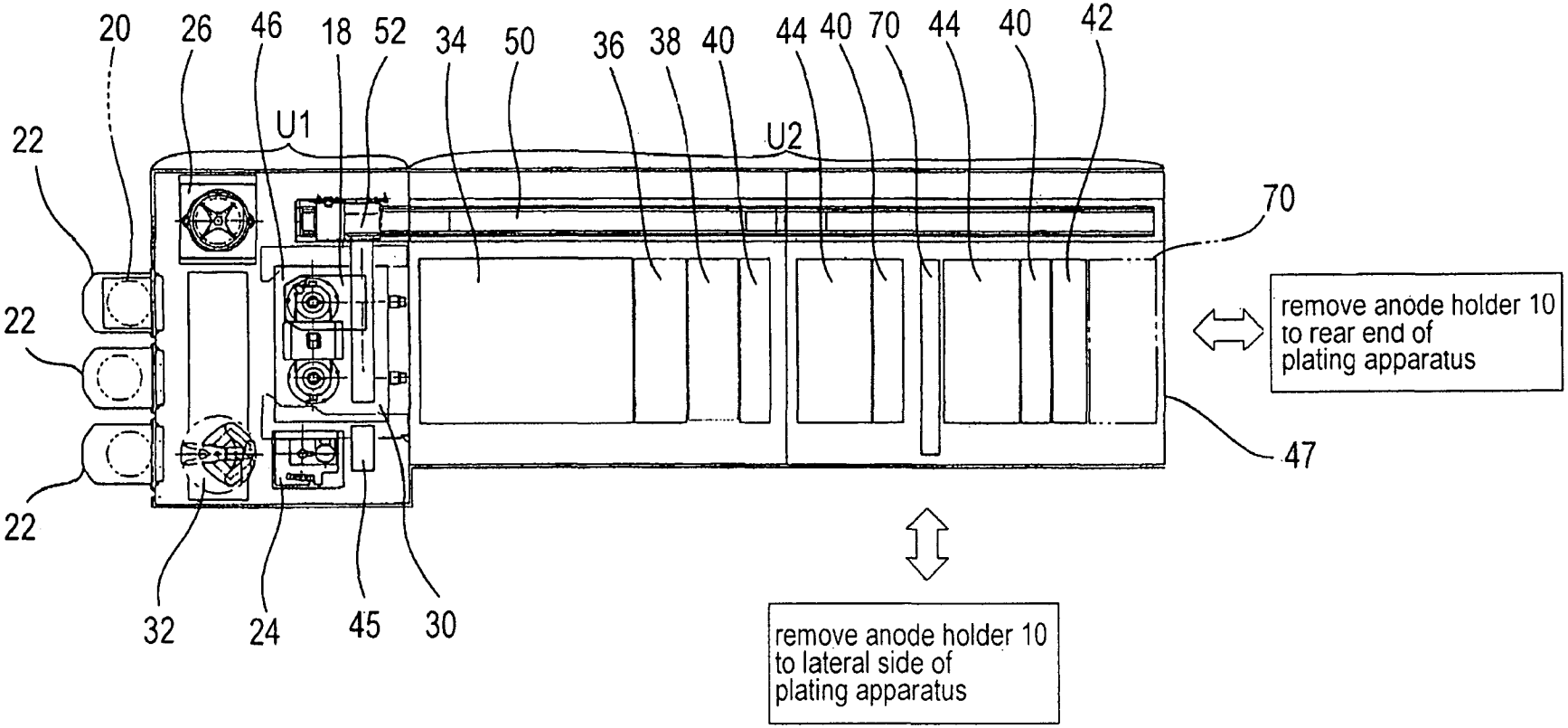
FIG. 9 is a schematic plan view showing a plating apparatus incorporating the conducting belt shown in FIGS. 1 through 4 and the anode holder shown in FIGS. 5 through 7.

FIG. 9 is a schematic plan view of the plating apparatus incorporating the conducting belt 1 shown in FIGS. 1 through 4 and the anode holder 10 shown in FIGS. 5 through 7.

As shown in FIG. 9, the plating apparatus comprises a loading/unloading unit U1 for loading and unloading the substrate W, and a plating processing unit U2 for performing various processing including plating of the substrate W, cleaning of the substrate W, and the like. The loading/unloading unit U1 comprises three cassette tables 22 for placing thereon cassettes 20 which house substrates W such as semiconductor wafers, an aligner 24 for aligning an orientation flat or a notch of a substrate W with a predetermined direction, and a spin drier 26 for drying the plated substrate W by spinning the plated substrate at a high speed. The loading/unloading unit U1 also has a substrate mounting/dismounting unit 30 for placing a substrate holder 18 thereon, and mounting the substrate W on the substrate holder 18 and dismounting the substrate W from the substrate holder 18. The cassette tables 22, the aligner 24, the spin drier 26, and the substrate mounting/dismounting unit 30 are disposed around a transfer robot 32 for transferring substrates W between the cassette tables 22, the aligner 24, the spin drier 26, and the substrate mounting/dismounting unit 30.

The plating unit U2 comprises, successively in order from the substrate mounting/dismounting unit 30, a stocker 34 for storing and temporarily placing substrate holders 18, a pre-wetting tank 36 for immersing a substrate W in pure water to wet the substrate W for making the surface of the substrate W highly hydrophilic, a pre-soaking tank 38 for etching away an oxide film having large electric resistance from a surface of a seed layer formed on the substrate W with a chemical solution such as sulfuric acid or hydrochloric acid, a water cleaning tank 40 for cleaning the surface of the substrate W and the anode holder 10 with pure water, a plating tank 44 for plating the substrate W, another water cleaning tank 40, another plating tank 44, still another water cleaning tank 40, and a blowing tank 42 for removing water from the cleaned substrate W and the cleaned anode holder 10. Each of the plating tanks 44 serves to perform copper plating of the substrate W. Alternatively, each of the plating tanks 44 may perform nickel plating, solder plating, or gold plating of the substrate W.

A transfer apparatus 50 is disposed alongside of the stocker 34 and the tanks 36, 38, 40, 42, 44 for transferring the substrate holders 18 together with the substrates W between these stocker and tanks. The transfer apparatus 50 includes a transporter 52 for transporting the substrates W between the substrate mounting/dismounting unit 30 and the stocker 34, and transporting the substrates W between the stocker 34, the pre-wetting tank 36, the pre-soaking tank 38, the water cleaning tanks 40, the plating tanks 44, and the blowing tank 42. The transporter 52 also serves to transport the anode holders 10 between a temporary storing unit 70 (described later), the pre-wetting tank 36, the pre-soaking tank 38, the water cleaning tanks 40, the blowing tank 42, and the plating tanks 44.

The substrate mounting/dismounting unit 30 comprises a flat support plate 46 angularly movable about a rotational shaft 45 at an angle of 90° between a vertical position and a horizontal position. Two substrate holders 18 are placed parallel to each other on the support plate 46 when the flat support plate 46 is in the horizontal position. After the substrate W is transferred between one of the substrate holders 18 and the transfer robot 32, the support plate 46 is angularly moved from the horizontal position to the vertical position, and transfers the substrate holder 18 to or from the transporter 52.

The temporary storing unit 70 for replacing an anode holder 10 and temporarily placing an anode holder 10 is disposed between the water cleaning tank 40 and the plating tank 44. Alternatively, the temporary storing unit 70 may be disposed in any position between any adjacent equipment located between the stocker 34 and the blowing tank 42. Further, the temporary storing unit 70 may be disposed between the blowing tank 42 and a housing 47 as indicated by the imaginary lines in FIG. 9.

The substantially T-shaped hands 11*b*, 11*b* provided on the upper end of the anode holder 10 serve as supports for transferring the anode holder 10 or suspending the anode holder 10 (see FIGS. 5 and 8). In the temporary storing unit 70, the anode holder 10 is vertically suspended by the hands 11*b* hanging on an upper surface of a circumferential wall of the temporary storing unit 70. Further, the anode holder 10 is transferred by the transporter 52 with the hands 11*b* of the suspended anode holder 10 gripped by the transporter 52. In each of the pre-wetting tank 36, the pre-soaking tank 38, the water cleaning tanks 40, the blowing tank 42, and the plating tanks 44, the anode holder 10 is suspended by the hands 11*b* hanging on an upper surface of a circumferential wall of the tank.

Figure 10:
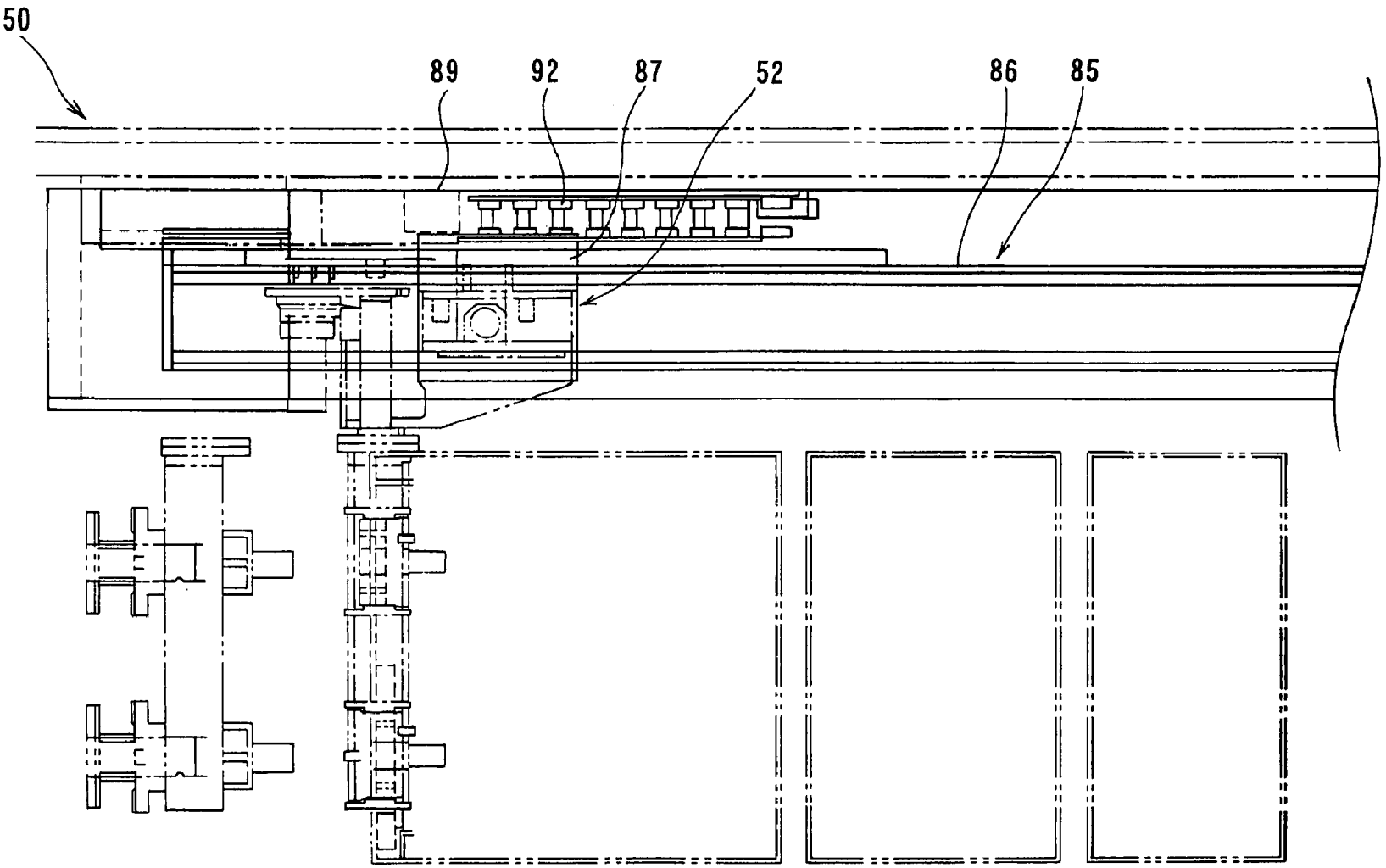
FIG. 10 is a plan view showing a linear motor unit of a transfer apparatus in the plating apparatus.
Figure 11:
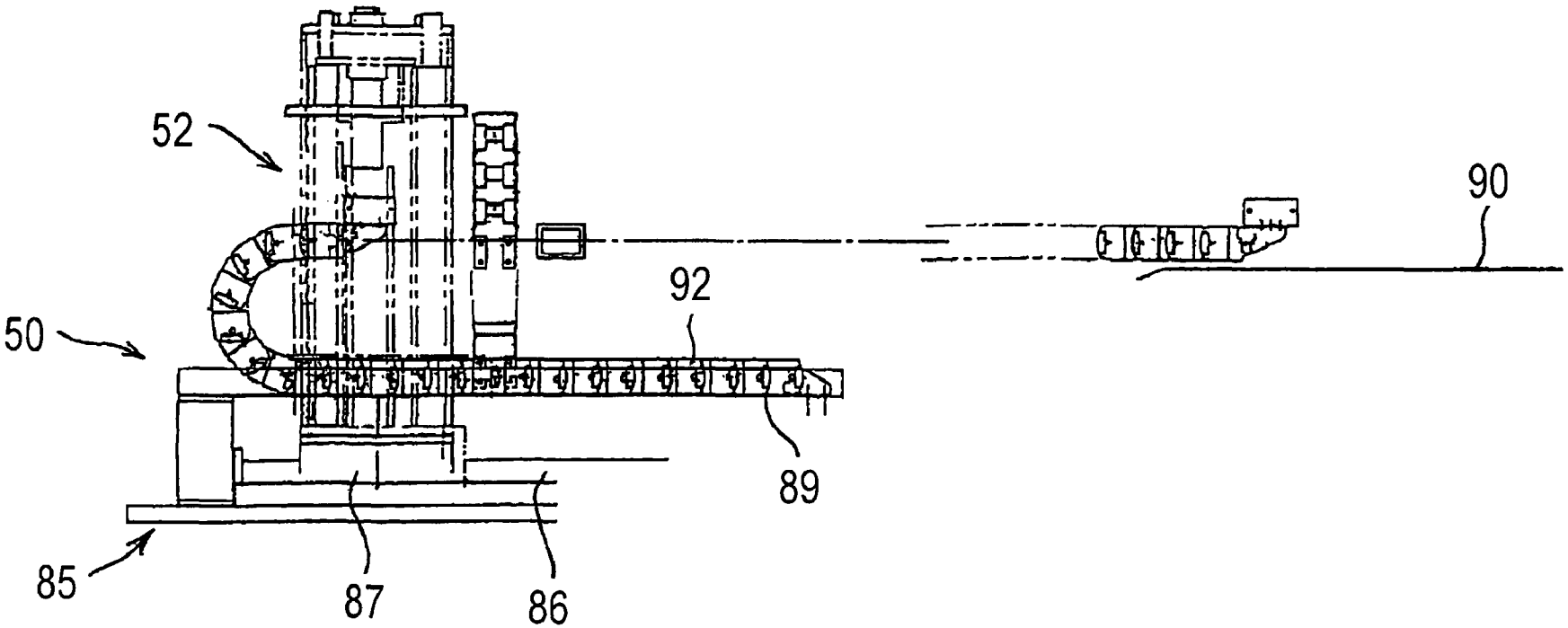
FIG. 11 is a front elevational view showing the linear motor unit shown in FIG. 10.

FIGS. 10 and 11 show a linear motor unit 85 as a driving unit of the transfer apparatus 50. Specifically, FIG. 10 is a plan view of the linear motor unit 58 of the transfer apparatus 50, and FIG. 11 is a front elevational view of the linear motor unit 58 shown in FIG. 10. As shown in FIGS. 10 and 11, the linear motor unit 85 basically comprises an elongate base 86 and a slider 87 movable along the base 86. The transporter 52 is mounted on an upper surface of the slider 87. A cable conveyer bracket 89 and a cable conveyer receiver 90 are disposed alongside of the base 86, and a cable conveyer 92 extends along the cable conveyer bracket 89 and the cable conveyer receiver 90.

As shown in FIGS. 10 and 11, since the transporter 52 is driven by the linear motor unit 85, the transporter 52 can be moved over a long distance and can be reduced in length to reduce the overall length of the transfer apparatus 50. The transfer apparatus 50 can be free of components such as a long ball screw which require dimensional accuracy and maintenance.

Figure 12:
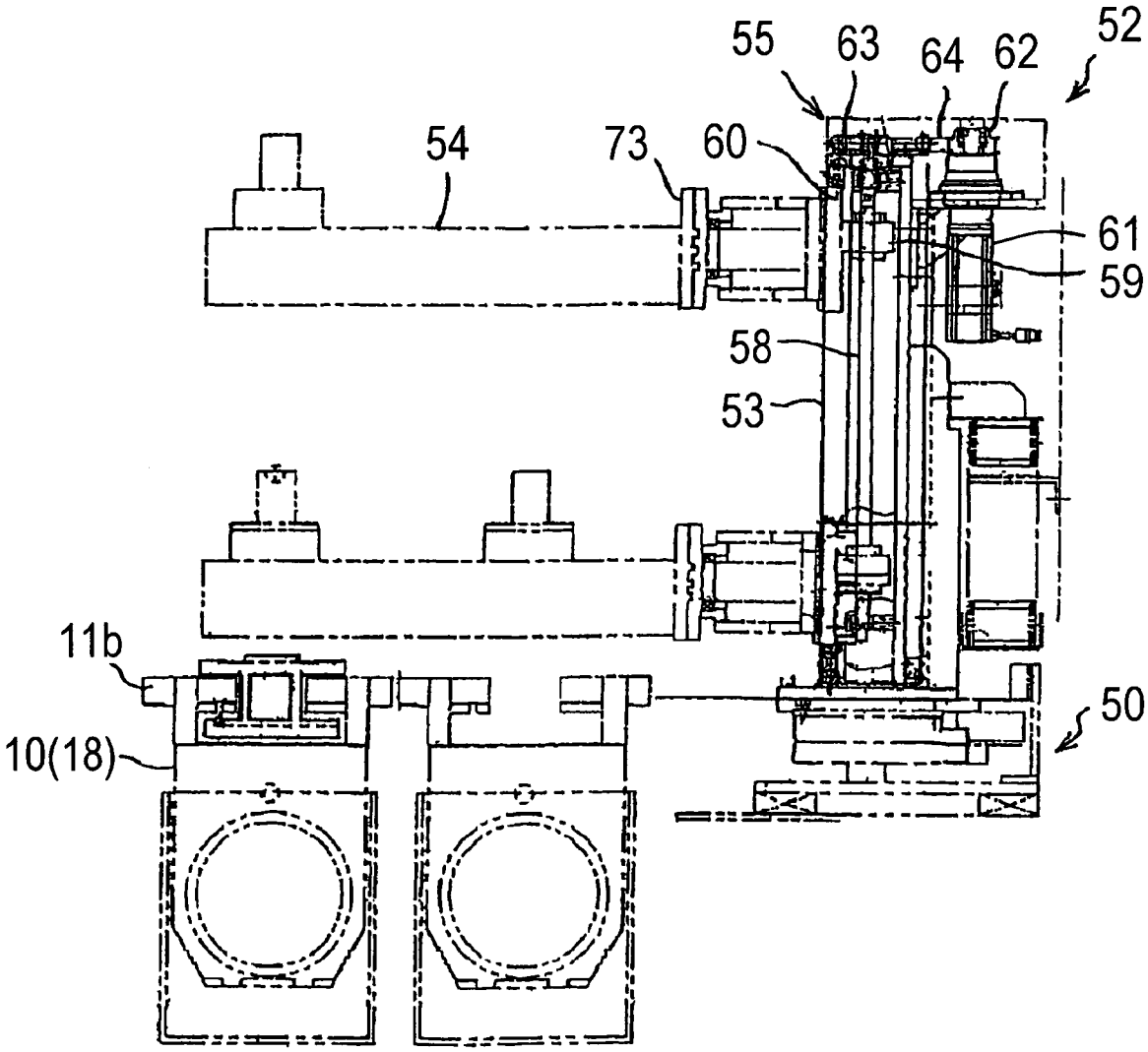
FIG. 12 is a front elevational view showing a transporter in the plating apparatus.
Figure 13:
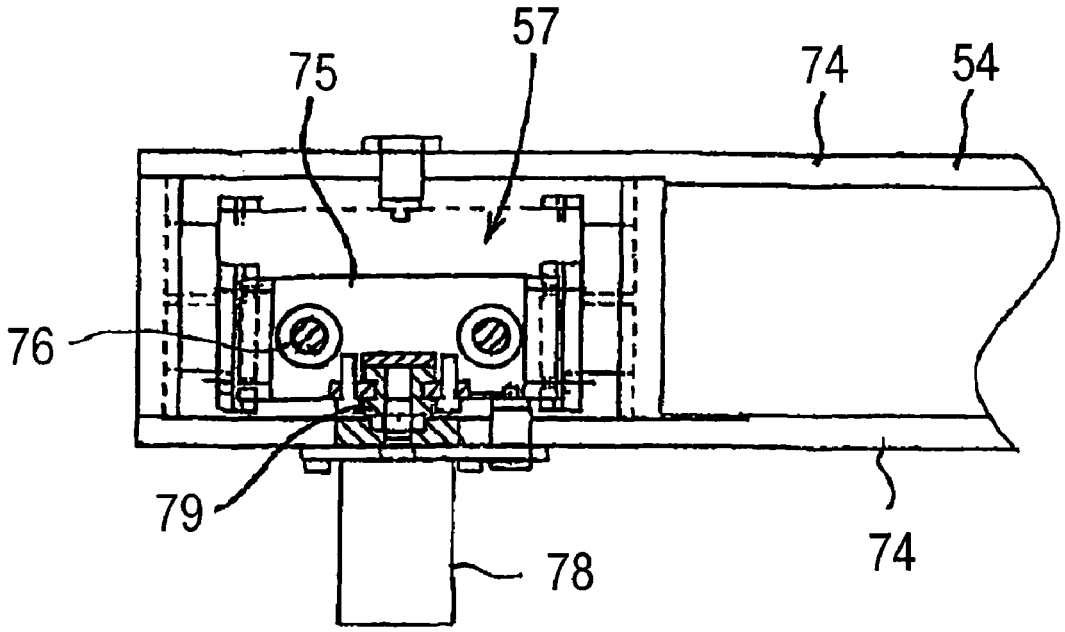
FIG. 13 is a plan view showing a gripping mechanism mounted on an arm of the transporter.
Figure 14:
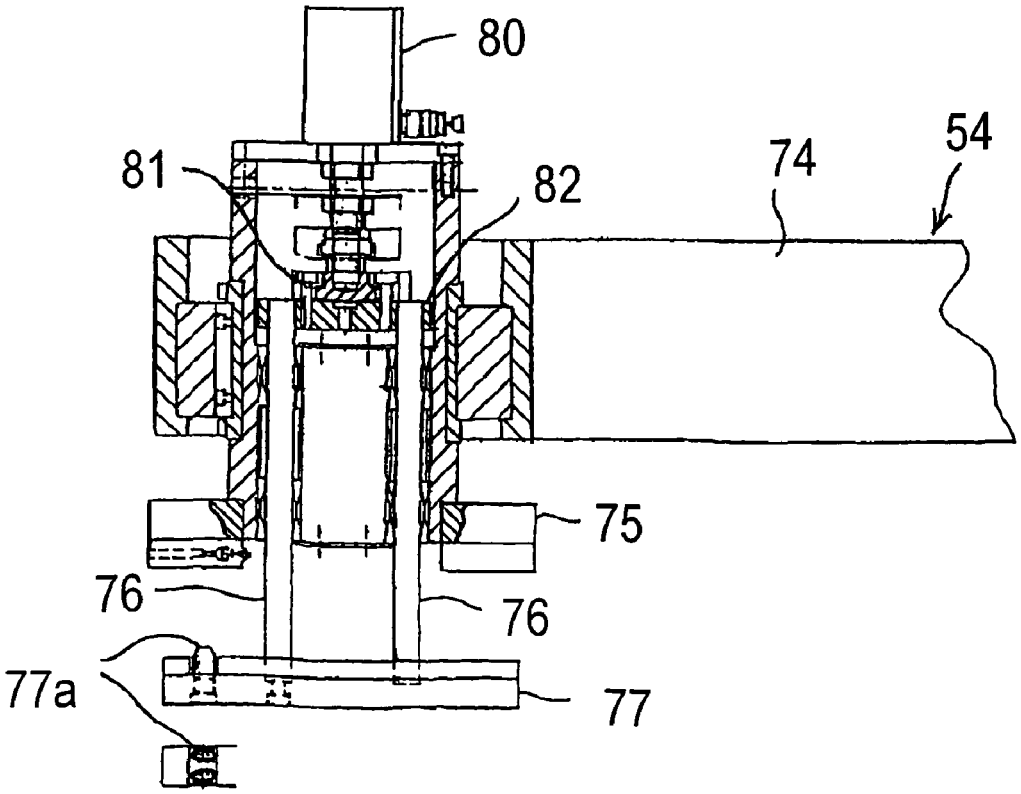
FIG. 14 is a vertical cross-sectional view showing the gripping mechanism shown in FIG. 13.

FIGS. 12 through 14 show the transporter 52 in detail. Specifically, FIG. 12 is a front elevational view of transporter 52, FIG. 13 is a plan view of a gripping mechanism mounted on an arm of the transporter 52, and FIG. 14 is a vertical cross-sectional view of the gripping mechanism. The transporter 52 comprises a transfer robot for transferring the substrate holder 18 and also transferring the anode holder 10. Hereinafter, the case where the transporter 52 transfers or transports the anode holder 10 will be described. As shown in FIGS. 12 and 13, the transporter 52 basically comprises a transporter body 53, an arm 54 extending laterally from the transporter body 53, an arm lifting/lowering mechanism 55 for lifting and lowering the arm 54, and gripping mechanisms 57 disposed in the arm 54 for detachably gripping the hands 11*b* of the anode holder 10. The arm lifting/lowering mechanism 55 comprises a rotatable ball screw 58 extending vertically, and a nut 59 screwed onto the ball screw 58. An LM base 60 is coupled to the nut 59. A timing belt 64 is trained around a drive pulley 62 fixed to a drive shaft of a lifting/lowering motor 61 and a driven pulley 63 fixed to the upper end of the ball screw 58. The drive shaft of the lifting/lowering motor 61 is fixed to the transporter body 53. When the lifting/lowering motor 61 is energized, the ball screw 58 is rotated about its own axis by the timing belt 64, and the LM base 60 coupled to the nut 59 which is screwed onto the ball screw 58 is vertically moved along an LM guide.

As shown in FIGS. 13 and 14, the arm 54 has a pair of spaced side plates 74 with the gripping mechanisms 57 disposed therebetween. Although the two gripping mechanisms 57 are shown in the illustrated embodiment, one of them will be described below as they are identical in structure to each other.

The gripping mechanism 57 comprises a fixed holder 75 having an end transversely movably disposed between the side plates 74, guide shafts 76 extending through the fixed holder 75, and a movable holder 77 coupled to ends (lower ends in FIG. 14) of the guide shafts 76. The fixed holder 75 is coupled by a cylinder joint 79 to a transversely moving cylinder 78 mounted on one of the side plates 74. A shaft holder 82 is connected to other ends (upper ends in FIG. 14) of the guide shafts 76. The shaft holder 82 is coupled to a vertically moving cylinder 80 by a cylinder connector 81.

When the transversely moving cylinder 78 is actuated, the fixed holder 75 is transversely moved between the side plates 74 together with the movable holder 77. When the vertically moving cylinder 80 is actuated, the movable holder 77 is vertically moved while being guided by the guide shafts 76.

For gripping the hands 11*b* of an anode holder 10 which is suspended in the temporary storing unit 70 or the like with the gripping mechanism 57, the movable holder 77 is lowered to a position lower than the hands 11*b* while the movable holder 77 is prevented from interferring with the hands 11*b*. Thereafter, the transversely moving cylinder 78 is actuated to position the fixed holder 75 above the hands 11*b* and to position the movable holder 77 beneath the hands 11*b*. Then, the vertically moving cylinder 80 is actuated to lift the movable holder 77 until the fixed holder 75 and the movable holder 77 grip the hands 11*b* therebetween. The hands 11*b* can be released when the vertically moving cylinder 80 is actuated to lower the movable holder 77.

As shown in FIG. 5, one of the hands 11*b* of the anode holder 10 has a recess 11*e* defined in a lower edge thereof. As shown in FIG. 14, the movable holder 77 has a projection 77*a* on an upper surface thereof which can be fitted into the recess 11*e* of the anode holder 10. When the hands 11*b* are gripped between the fixed holder 75 and the movable holder 77, the projection 77*a* is fitted into the recess 11*e* to position and orient the hands 11*b* properly.

A processing operation of the plating apparatus constructed as shown in FIGS. 9 through 14 will be described below. Hereinafter, the replacement work of the anode will be mainly described. First, a process of plating the substrate W will briefly be described below. After the substrate W is mounted on the substrate holder 18 in the loading/unloading unit U1, the transporter 52 of the transfer apparatus 50 grips the substrate holder 18 and suspends (temporarily places) the substrate holder 18 in the stocker 34. Then, the transporter 52 removes the substrate holder 18 from the stocker 34, and conveys the substrate holder 18 successively through the pre-wetting tank 36, the pre-soaking tank 38, the plating tanks 44, and the water cleaning tanks 40 for successively pre-wetting, pre-soaking, plating, and cleaning the substrate W.

When the above plating process is repeated, the anode 5 is exhausted and needs to be replaced with a new one. A process of replacing the anode 5 will be described below.

The anode holder 10 which is immersed in the plating tank 44 and holds the exhausted anode 5 is lifted by the transporter 52. At this time, the gripping mechanism 57 of the transporter 52 grips the anode holder 10, and the arm 54 is lifted by the arm lifting/lowering mechanism 55. Thereafter, the anode holder 10 is conveyed to the adjacent water cleaning tank 40. Then, the arm 54 is lowered by the arm lifting/lowering mechanism 55 to bring the anode holder 10 into the water cleaning tank 40 in which the anode holder 10 is cleaned with water. The cleaned anode holder 10 is transferred by the transporter 52 to the blowing tank 42 in which water droplets are removed from the anode holder 10.

Thereafter, the anode holder 10 is conveyed to the temporary storing unit 70 by the transporter 52. Then, the anode holder 10 is taken out of the plating apparatus through the temporary storing unit 70 onto a working table (not shown). At this time, the anode holder 10 is removed from the lateral side of the plating apparatus. If the temporary storing unit 70 is positioned between the blowing tank 42 and the housing 47 as indicated by the imaginary lines in FIG. 9, then the anode holder 10 can be removed from the rear end of the plating apparatus. On the working table, the rear cover 12 is detached from the anode holder 10, the conducting belt 1 is loosened, the exhausted anode 5 is replaced with a new anode 5, and the conducting belt 1 is retightened. The conducting belt 1 can be loosened simply by loosening the nuts 7, and can be retightened simply by retightening the nuts 7.

Then, the rear cover 12 is attached to the anode holder base 11, thereby completing the process of mounting the new anode 5 on the anode holder 10. The anode holder 10 with the new anode 5 mounted therein is returned to the temporary storing unit 70 in the plating apparatus, and is then put back into the plating tank 44 by the transporter 52.

The plating apparatus constructed as shown in FIGS. 9 through 14 offers the following advantages:

1) Since the anode holder 10 is removed by the transporter (transfer robot) 52 which is fully automatized, the anode holder 10 can easily be replaced.

2) For removing the anode holder 10 from the plating apparatus, the anode holder 10 is taken out of the plating tank 44 by the transporter (transfer robot) 52, cleaned in the water cleaning tank 40, which is also used to clean the substrate W, to remove the plating solution from the anode holder 10, dried in the blowing tank 42, which is also used to dry the substrate W, and removed from the plating apparatus through the temporary storing unit 70. The temporary storing unit 70 serves as an anode holder exchange area. Since the operator is not required to touch the plating solution for the removal of the anode holder 10, the safety of the operator can be ensured.

3) Since the anode holder 10 can easily be removed, the anode mask 13 can easily be replaced.

4) The transporter (transfer robot) 52 has a high level of positioning accuracy, and can perform fine adjustment of position. Consequently, the anode holder 10 can be placed in a desired position with high reproducibility, and the interelectrode distance between the substrate W and the anode 5 can easily be changed.

Although certain preferred embodiments of the present invention have been shown and described in detail, it should be understood that various changes and modifications may be made therein without departing from the scope of the appended claims.

What is claimed is:

1. A conducting belt composed of an electrically conductive material, for use with an anode holder for supplying an electric current to an anode, said anode and a substrate being vertically disposed so as to face each other in a plating tank of a plating apparatus, said conducting belt comprising:

a ring-shaped belt portion capable of contacting substantially an entirety of an outer circumferential edge of said anode;

holding portions extending from ends of said ring-shaped belt portion;

a first fastener attached to said holding portions for fastening said ring-shaped belt portion to said anode;

a fixing portion extending from one of said holding portions;

an electrically conductive bracket having a contact for supplying an electric current from a plating power supply source to said anode; and a second fastener attached to said fixing portion for fastening said electrically conductive bracket to said fixing portion.

2. A conducting belt according to claim 1, wherein said first fastener comprises a bolt and a nut.

3. A conducting belt according to claim 1, wherein said second fastener comprises a bolt and a nut.

4. A conducting belt according to claim 1, wherein said fixing portion has a notch through which said second fastener is inserted.

5. A conducting belt according to claim 1, wherein each of said ring-shaped belt portion, said holding portions, and said fixing portion has a width in a range of 1 cm to 2 cm.

6. An anode holder for vertically holding an anode, said anode and a substrate being vertically disposed so as to face each other in a plating tank of a plating apparatus, said anode holder comprising:

an anode holder base having a hole defined therein for housing a conducting belt for supplying an electric current to said anode;

wherein said conducting belt comprises a belt capable of contacting an outer circumferential edge of said anode and holding said anode.

7. An anode holder according to claim 6, further comprising:

a rear cover mounted on a rear surface of said anode holder base for covering a rear surface of said anode.

8. An anode holder according to claim 6, wherein said anode holder base includes a hand for transferring said anode holder.

9. An anode holder according to claim 8, wherein said hand is positioned above a plating solution.

10. An anode holder according to claim 8, wherein said hand is configured to hold a contact connected to a plating power supply source.

11. An anode holder according to claim 6, wherein said anode holder base includes a solution discharge hole for allowing a solution to be discharged therethrough.

12. An anode holder according to claim 6, wherein said belt is capable of contacting substantially an entirety of the outer circumferential edge of said anode.

13. An anode holder according to claim 6, wherein said belt has opposite ends fastened to each other by a fastener to hold said anode.

14. An anode holder according to claim 13, wherein said fastener comprises a bolt and a nut.

15. An anode holder according to claim 6, further comprising:

an electrically conductive bracket fixed to an end of said belt, said electrically conductive bracket having a contact for supplying the electric current.

16. An anode holder according to claim 6, further comprising an anode mask mounted on a front surface of said anode holder base for covering a portion of a front surface of said anode.

17. An anode holder according to claim 16, wherein said anode mask has a circular opening, and said circular opening has a diameter smaller than a diameter of said anode.

18. A plating apparatus comprising:

a plating tank for vertically placing therein an anode holder holding an anode and a substrate holder holding a substrate thereon in confronting relation to each other;

a temporary storing unit for allowing exchange of said anode holder; and a transfer robot for transferring said anode holder between said plating tank and said temporary storing unit;

said anode holder comprising:

an anode holder base having a hole defined therein for housing a conducting belt for supplying an electric current to said anode;

wherein said conducting belt comprises a belt capable of contacting an outer circumferential edge of said anode and holding said anode.

19. A plating apparatus according to claim 18, further comprising:

a cleaning tank for cleaning said anode holder.

20. A plating apparatus according to claim 18, further comprising:

a blowing tank for removing water droplets from said anode holder.

21. A plating apparatus according to claim 18, further comprising an anode mask mounted on a front surface of said anode holder base for covering a portion of a front surface of said anode.

22. A method of transferring an anode holder, comprising:

lifting an anode holder holding an anode immersed in a plating solution in a plating tank from said plating tank by using a transfer robot;

transferring said anode holder holding the anode to a water cleaning tank by using said transfer robot;

cleaning said anode holder holding the anode with water in said water cleaning tank to remove the plating solution from said anode holder;

lifting said anode holder holding the anode from said water cleaning tank by using said transfer robot; and transferring said anode holder by using said transfer robot to a temporary storing unit which is accessible outside of a plating apparatus;

wherein said anode holder comprises an anode holder base having a hole defined therein for housing a conducting belt for supplying an electric current to said anode; and said conducting belt is configured to contact an outer circumferential edge of said anode and to hold said anode.

23. A method of transferring an anode holder according to claim 22, further comprising:

lifting said anode holder holding the anode from said plating tank; and discharging the plating solution from said anode holder through a solution discharge hole defined in a lower end of said anode holder.

24. A method of transferring an anode holder according to claim 22, further comprising removing water droplets from said anode holder holding the anode by blowing after cleaning said anode holder with water.

25. An electroplating method comprising:

placing an anode held by an anode holder in a plating solution of a plating tank;

connecting said anode to a plating power supply source through a contact of said anode holder;

placing a surface to be plated of a substrate held by a substrate holder in the plating solution of the plating tank so as to face said anode;

connecting the surface to be plated of the substrate to said plating power supply source; and electroplating the surface to be plated of the substrate by supplying an electric current between said anode and the substrate;

wherein said anode holder comprises an anode holder base having a hole therein for housing a conducting belt for supplying an electric current to said anode; and said conducting belt is configured to contact an outer circumferential edge of said anode and to hold said anode.

* * * * *